United States Patent [19]

Brausfeld et al.

[11] Patent Number: 4,680,436

[45] Date of Patent: Jul. 14, 1987

[54] PROXIMITY SWITCH IN MOUNTING ARRANGEMENT

[75] Inventors: Walter Brausfeld, Hanover; Helmut Gottling, Isernhagen; Rudolf Moller, Gehrden; Peter Muller, Hanover; Gerhard Scharnowski, Gehrden, all of Fed. Rep. of Germany

[73] Assignee: WABCO Westinghouse Steuerungstechnik GmbH & Co., Hanover, Fed. Rep. of Germany

[21] Appl. No.: 879,688

[22] Filed: Jul. 28, 1986

[30] Foreign Application Priority Data

Jun. 29, 1985 [DE] Fed. Rep. of Germany ..... 3523371
Mar. 21, 1986 [DE] Fed. Rep. of Germany ..... 3609537

[51] Int. Cl.[4] ..... H01H 35/38

[52] U.S. Cl. ..... 200/82 E; 73/745; 335/205

[58] Field of Search ..... 91/1; 92/5 R; 340/626; 73/708 X, 745 X, 744, 746; 335/205 X-207; 200/81.4, 81.5, 82 R, 82 E, 81 R

[56] References Cited

U.S. PATENT DOCUMENTS 4,086,456 4/1978 Bone ..... 200/82 E
4,594,987 6/1986 Grassl ..... 335/205
4,608,870 9/1986 Huber ..... 200/82 E

FOREIGN PATENT DOCUMENTS 2917232 11/1979 Fed. Rep. of Germany .

*Primary Examiner*—G. P. Tolin
*Attorney, Agent, or Firm*—G. E. Hawranko

[57] ABSTRACT

A contactless proximity switch and mounting arrangement for determining the position of a movable member within a cylinder which has two end covers secured on the cylinder by means of a plurality of tie rods, includes a switch housing which secures to one of the tie rods. A contact opening formed in the switch housing has disposed therein, a switch having a pair of contacts and a permanent magnet disposed in a fixed manner. One pole of the permanent magnet is connected to a first contact, while the second pole is disposed in a contacting relation to the cylinder. A second contact is electrically coupled to the cylinder at a position a predetermined distance from where the second pole is disposed. As the movable member, which is constructed of a ferromagnetic material, nears the switch housing, the air gap between the second contact and second pole is bridged and the contacts close indicating the proximity of the movable member to the switch element. The entire proximity switch apparatus can be moved along the longitudinal axis of the cylinder.

12 Claims, 4 Drawing Figures

FIG. 1
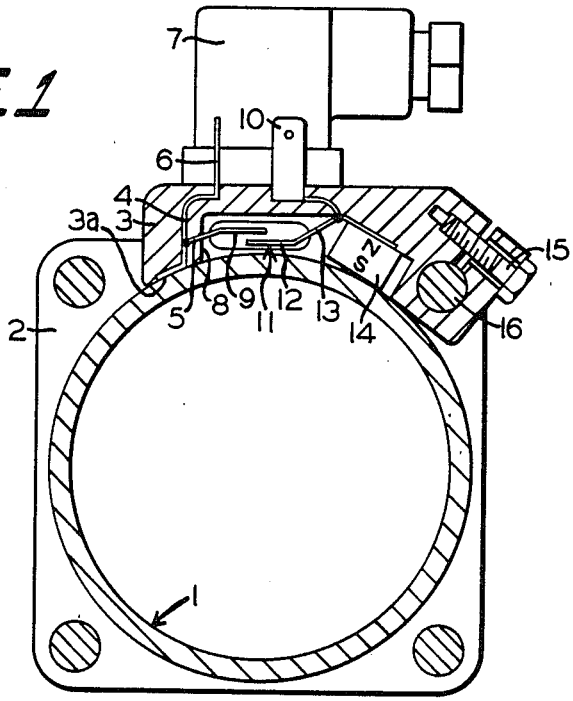
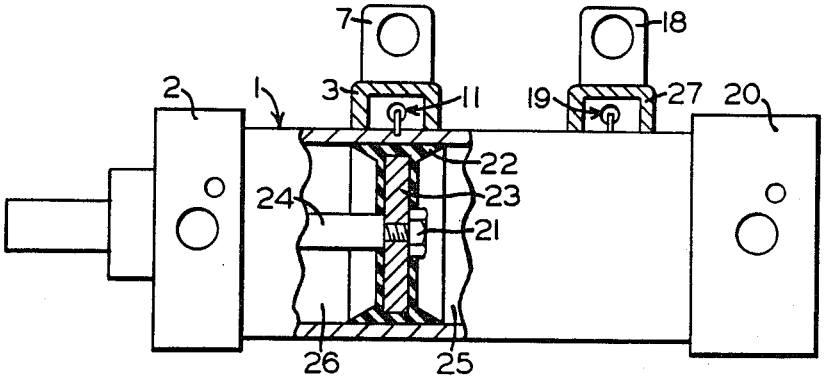
FIG. 2

PROXIMITY SWITCH IN MOUNTING ARRANGEMENT

BACKGROUND OF THE INVENTION

This invention relates to a contactless proximity switch apparatus and an arrangement for mounting the same. Such contactless proximity switch and mounting arrangement are especially advantageous for use with work cylinders where it is required to detect the position of the piston within the work cylinder. To date, a typical work cylinder having a reciprocally moveable piston disposed therein employed an element disposed inside the cylinder and usually mounted such element on the piston itself to act as a portion of the piston position determining arrangement. An example of such an approach can be found in the German Pat. No. DE 29 17 232, where a reed contact switch disposed on the cylinder jacket was activated when a magnet element, secured to the piston head, came into proximity to thus close the contacts of the reed switch. The disadvantage of such an approach is that the internal layout of the piston and rod structure must be modified to accommodate placement of the magnetic element, which placement requires additional space and interferes with the piston movement. Still other proximity switch devices employ a contoured jacket which fits over the cylinder and employs either a resistance or inductance measuring arrangement to determine the position of the piston; in this situation, the external jacket portion must be precisely contoured to the shape of the cylinder, such precision-contoured jacket being required in as many different sizes as there are different-sized cylinders.

SUMMARY OF THE INVENTION

It is, therefore, an object of the invention to provide a contactless proximity switch and mounting arrangement for use with a work cylinder where it is required to detect the position of the piston within the work cylinder and where the proximity switch and mounting arrangement are of a simple and efficient construction.

It is a further object of the invention to provide such a contactless proximity switch and mounting arrangement where it is not required to modify the interior of the work cylinder in size or construction in order to install such switch and mounting arrangement.

An even further object of the invention is to provide such a contactless proximity switch and mounting arrangement which provides a single-sized construction regardless of the size of the work cylinder.

Yet a further object of the invention is to provide such a contactless proximity switch and mounting arrangement which will at all times occupy the identical position on the work cylinder, which positioning includes the distance from the jacket surface of the work cylinder that is required for proper operation of the work cylinder.

Briefly, the invention consists of a contact housing which is fastened externally to a work cylinder in which a piston reciprocally moves, such fastening occurring at and around a portion of one of the tie rods which secures the cylinder ends to the cylinder housing. The contact housing has an inner arcuately-contoured surface which conforms to any cylindrical shape such that the contact housing rests securely against the cylinder jacket. Formed adjacent the arcuate side is a contact opening which has contained therein a pair of contacts and a permanent magnet. A lead line is taken from one pole of the permanent magnet to a first contact, while a second lead line goes from a second contact to secure between the contact housing and the cylinder housing. The piston contains a center core formed of a ferromagnetic material such that, when in proximity to the permanent magnet, the air gap between the opposite pole of the permanent magnet as is connected to the first contact and the second lead line is closed, and the contacts then are closed. First and second lead lines branch off also to respective first and second blade contacts which can be externally coupled to convey the information as to the condition of the first and second contacts.

BRIEF DESCRIPTION OF THE DRAWINGS

FIG. 1 is an elevational view in section of a contactless proximity switch and mounting arrangement constructed in accordance with the invention.

FIG. 2 is an elevational view partly in section of a work cylinder having mounted thereon the contactless proximity switch and mounting arrangement constructed in accordance with the invention.

DESCRIPTION AND OPERATION

Figure 3:
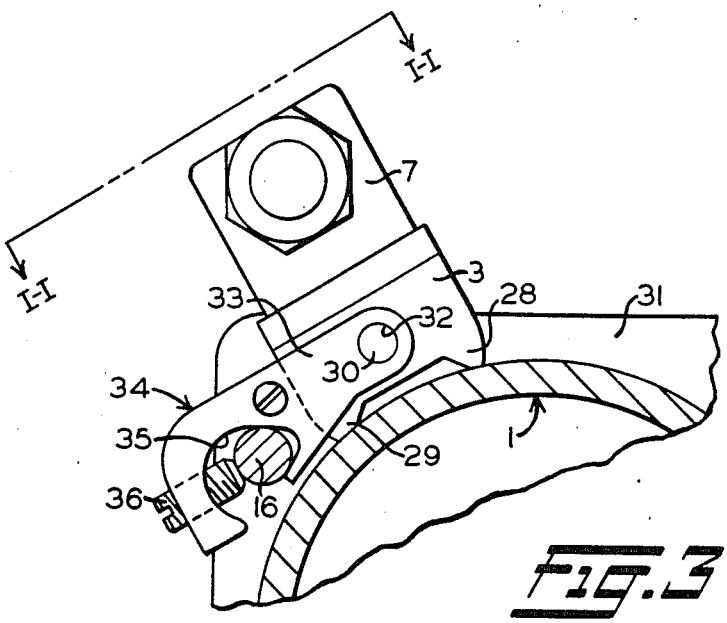
FIG. 3 is an elevational view partly in section of a contactless proximity switch and mounting arrangement constructed in accordance with an alternate embodiment of the invention.

As shown in FIG. 1, a work cylinder 1 has a first cylinder end cover 2, whereby the cylinder end cover 2 is connected by means of four tie rods 16 with a cylinder base 20, as shown in FIG. 2.

Fastened to one of the tie rods 16 by means of a first screw 15 is a contact housing 3, which opens toward the work cylinder 1. The contact housing 3 of the contactless proximity switch apparatus has disposed therein the first proximity switch element 11, which operates as a function of the magnetic field to sense the relative approach or retreat of a body to or from the first proximity switch element 11. Contact housing 3 is arranged in relation to the work cylinder 1 so that it is in contact with the work cylinder 1 in a manner wherby an inner contour 3*a* of the contact housing 3 is arcuately shaped to conform to the shape of the outer cylinder walls. The contact opening 8 is formed along this inner contour 3*a* and is opened to the exterior surface of the work cylinder 1.

The proximity switch apparatus is formed by the first proximity switch element 11, which is designed as a reed contact element located in the contact opening 8 of the contact housing 3, and which first proximity switch element 11 exhibits two separate reed elements serving as first and second contact mechanisms 9 and 12. Additionally, a permanent magnet 14 is located on the contact opening 8 of the contact housing 3. The permanent magnet 14 is also fixed in relation to the proximity switch element 11. Permanent magnet 14 is used to produce a magnetic field which activates the first proximity switch element 11. The first contact mechanism 9 is connected via a first connecting wire 5 with the work cylinder housing 1, preferably so that the first connecting wire 5 is clamped between the work cylinder housing 1 and the inner contour 3*a* of the contact housing 3. Another, second connecting wire 4, branches off from the first connecting wire 5 and leads to a first plug connection 6 for a connection plug 7 which is designed as a blade-type contact. The other, second contact mechanism 12, is connected via a third connecting wire 13 with one pole of the permanent magnet 14, in this embodiment with the "N" pole. From the same "N" pole of the permanent magnet 14, a fourth connecting wire 17 leads to another, second plug connection 10, also designed as a blade contact. The first and second plug connections 6 and 10 are located on the contact housing 3 and are connected with the connection plug 7.

FIG. 2 shows the work cylinder 1 with two proximity switch devices 11, 19. For the sake of uniformity, the components, which are the same as those illustrated in FIG. 1, are identified by the same numbers.

In the cylinder 1, which is closed on its end by a cylinder base 20 and the cylinder cover 2, which are connected to one another by means of the plurality of tie rods 16, not shown in FIG. 2, a piston 22, 23 can be moved in a sealed manner. The piston consists of a double cup collar 22 and a disc-shaped body 23, which is composed of a ferromagnetic material, such as a soft iron disc. The disc-shaped body 23 serves as a carrier for the double cup collar 22. The piston 22, 23 is connected by means of a second screw 21 with a piston rod 24.

On the work cylinder 1, there is the first proximity switch element 11, as well as a second proximity switch element 19, both of which can be designed as reed contact elements which operate as a function of the magnetic field similar to the first proximity switch element 11; the second proximity switch element 19 as well includes a second permanent magnet (not shown). Each of the two proximity switch device 11, 19 is provided with respective first and second connection plugs 7, 18. The first and second connection plugs 7, 18 are connected with solenoid valve devices (not shown) to control the pressurization of the first and second pressure chambers 25, 26 of the work cylinder 1. The first and second proximity switch elements 11, 19 are part of a circuit which connects a voltage source with the solenoid valve devices (not shown).

In operation, with references to FIGS. 1 and 2, it is assumed that the piston 22, 23 of the work cylinder 1 is in the center position and that the first and second contact mechanisms 9, 12 of the first proximity switch element 11 as well as the contact mechanisms of the second proximity switch element 19 are in a position in which they are not in contact with one another, that is, they are open. By means of the third connecting wire 13, connecting the permanent magnet 14 with the second contact mechanism 12 of the first proximity switch element 11, the magnetic flux of the permanent magnet 14 is conducted through the first proximity switch element 11. The magnetic flux travels from the "N" pole of the permanent magnet 14 via the third connecting wire 13, the first and second contact mechanisms 9, 12 and the first connecting wire 5 to the "S" pole of the permanent 14. Since the air gap between the first connecting wire 5 and the "S" pole of the permanent magnet 14 is large, the magnetic flux of the first proximity switch element 11 is relatively weak so that the magnetic force is not sufficient to close the first and second contact mechanisms 9, 12.

If fluid pressure is introduced into the first pressure chamber 25 and the piston 22, 23 is to be displaced by the pressure building up in the first pressure chamber 25 leftward toward the second pressure chamber 26 on the piston rod side, the piston 22, 23 arrives in the vicinity of the first proximity switch element 11. On account of the soft iron disc 23 of the piston 22, 23, the air gap, therefore, becomes smaller. The magnetic flux in the first proximity switch element 11 is increased on account of the now-stronger magnetic field in the vicinity of the first proximity switch element 11, and the first and second contact mechanisms 9, 12 are brought into contact with one another, that is, closed. The circuit is now closed and the solenoid valve apparatus (not shown) receives a switch pulse. The solenoid valve apparatus then reverses so that the fluid pressure fed to the first pressure chamber 25 is interrupted, this first pressure chamber 25 is then evacuated, and the second pressure chamber 26, on the piston rod side, is pressurized. The piston 22, 23 is moved to the right by the fluid pressure building up in the second pressure chamber 26 on the piston rod side. As soon as the piston 22, 23 has left the vicinity of the first proximity switch element 11, the magnetic flux in this first proximity switch element 11 again lessens, and the contact mechanisms 9, 12 open. The circuit in which the first proximity switch element 11 and the solenoid valve apparatus (not shown) are located is now broken. If the piston 22, 23, in its further movement toward the first pressure chamber 25, arrives in the vicinity of the second proximity switch element 19, the magnetic flux in this second proximity switch element 19 increases and the third and fourth contact mechanism (not shown) of the second proximity switch element 19 are closed. The solenoid valve apparatus (not shown) again reverses so that the feed of fluid pressure to the second pressure chamber 26 on the piston rod side is interrupted, the second pressure chamber 26 on the piston rod side is evacuated and the first pressure chamber 25 opposite the second pressure chamber 26 on the piston rod side is pressurized.

FIG. 3 shows a proximity switch apparatus which is fastened by means of a lever serving as a mounting apparatus to a tie rod 16 of the work cylinder 1. For the sake of uniformity, the same identifying numbers have been used as for the same components of FIG. 1.

On the work cylinder 1, there is a proximity switch element 11 surrounded by the contact housing 3 and on which the first connection plug 7 is mounted. The contact housing 3 exhibits, on its side facing the work cylinder 1, two lug-type projections 28, 29 located parallel to one another, by means of which the contact housing 3 is put in contact with the work cylinder housing 1. The contact housing 3 has on each of two sides opposite one another pivot pins 30 extending outwardly, running parallel to the longitudinal axis of the work cylinder 1. A lever serving as the mounting apparatus for the proximity switch element 11 exhibits, on its end facing the contact housing 3, a pivot lug 32, which is used to hold the free end region of the pivot pin 30. The pivot pin 30 and the pivot lug 32 are used as a joint which makes it possible for the proximity switch element 11 to rotate around its longitudinal axis, which runs parallel to the longitudinal axis of the cylinder housing 1. The end region of the lever 33, 34, away from the contact housing 3 of the proximity switch apparatus, has a recess 35 designed in this embodiment in the manner of a jaw, which partly surrounds a pivot bolt formed by a tie rod 16 of the work cylinder 1. This tie rod 16 and the three other tie rods (not shown here) serve as the connection between the cylinder cover 31 and the cylinder base (not shown) which define the work cylinder 1 on its ends. In the end region portion 34 of the lever 33, 34, provided with the jaw-like recess 35, there is a fastening screw 36 serving as a binding post, which is in contact with the tie rod 16, and thus braces the tie rod 16 and the lever 33, 34 against one another.

The mounting of the proximity switch apparatus, shown generally at reference 11, takes place first by placing the lever 33, 34 with its end provided with the pivot lug 32 on the pivot pin 30 of the contact housing 3 of the proximity switch element 11, and then suspending the lever 33,34 with the jaw-like recess 35, now fastened in a hinged manner to the proximity switch element 11, on the tie rod 16. Then, the contact housing 3 of the proximity switch element 11 is oriented in relation to the work cylinder 1 so that it is in contact by means of the first and second lug-like projections 28, 29 on the work cylinder 1. By turning the fastening screw 36 into the end region portion 34 of the lever 33, 34, exhibiting the jaw-like recess 35, until the fastening screw 36 comes in contact with the tie rod 16, the lever 33, 34 connected with the proximity switch element 11 in the tie rod 16 are connected with one another in a manner which prevents relative rotation.

If another position is desired for the proximity switch element 11, the fastening screw 36 is loosened and the lever 33, 34 connected with the proximity switch element 11 is pushed on the tie rod 16 along the longitudinal axis of the work cylinder 1.

As a result of the fact that the lever 33, 34, serving as the mounting apparatus for the proximity switch element 11, is connected in a pivoting manner by means of a first pivot 30, 32 with the proximity switch element 11 and by means of a second pivot, which in this embodiment is formed by the tie rod 16 and the jaw-like recess 35 of the end region portion 34 of the lever 33, 34, in a hinged manner with the work cylinder 1 or with a part located on the work cylinder 1 (e.g., the tie rod 16), the proximity switch element 11 can be fastened to any work cylinder 1 without the need for modifications to the proximity switch element 11, or to the mounting apparatus. Regardless of the diameter of the work cylinder in question, the proximity switch element 11 always assumes the same position in relation to the work cylinder required for its operation, and in relation to the piston 22, 23, equipped with the ferromagnetic disc part 23. The pivot end portion 33 of the lever 33, 34, connected in a pivoting manner with the proximity switch element 11, can, to simplify installation, also exhibit a jaw-like recess instead of the bearing lug 32.

Figure 4:
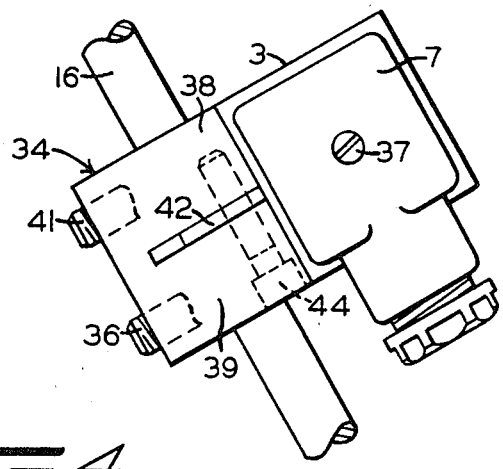
FIG. 4 is an elevational view of a contactless proximity switch and mounting arrangement taken along lines 1—1 of FIG. 3.

FIG. 4 shows an overhead view of the mounting apparatus illustrated in FIG. 3 for the proximity switch element 11. For the sake of uniformity, identical components are identified by the case numbers as in FIG. 3.

The mounting apparatus, according to FIG. 4, illustrates that the lever 33, 34 can have two lever arms 38, 39 whereby a slot 42, running perpendicular to the longitudinal axis of the tie rod 16, separates the two lever arms 38, 39. These lever arms 38, 39 of the lever 33, 34, formed by the slot 42, and running parallel to one another are narrower in the vicinity of the proximity switch apparatus 11 than in the vicinity of the end region portion 34 of the lever 33, 34. The narrower region of the lever arms 38, 39 thus form a fork-like part, and in whose free-end region there are recesses to hold the pivot pins 32 located on the contact housing 3 of the proximity switch element 11. The pivot formed in this manner between the contact housing 3 of the proximity switch element 11 and the lever arms 38, 39 makes possible a rotation of the proximity switch element 11 relative to the lever arms 38, 39 around an axis of the contact housing 3 running parallel to the longitudinal axis of the work cylinder 1. The end region portion 34 of the two-lever-arm arrangement 38, 39 away from the contact housing 3 of the proximity switch element 11 exhibits the jaw-like recess 35, which partly surrounds the tie rod 16. To brace this lever arrangement 33, 34 with the tie rod 16, there are two fastening screws 36, 41 screwed into the jaw-like recess 35 of the end region portion 34. Near the fork-like portion of the lever arms 38, 39, there is an opening 37 provided with a partial thread 43, into which a third screw 44 is turned. By means of the third screw 44, the two lever arms 38, 39 can be moved in relation to one another so that, between the lever arms 38, 39 in the contact housing 3 of the proximity switch element 11, a clamp connection can be achieved. It is also possible, of course, to design the mounting apparatus so that it can be adjusted in the direction perpendicular to the longitudinal axis of the work cylinder 1.

The use of the contactless proximity switch apparatus and mounting arrangement described above is, of course, not limited to the embodiment. The contactless proximity switch apparatus can be used wherever the position of one of two parts which can move in relation to one another is to be measured, and used, for example, as a switching criteria. For the proper operation of the contactless proximity switch apparatus described above, it is important that the part of the body consisting of the ferromagnetic material (reference 23 of the piston 22, 23 in the embodiment) is designed and guided so that it can increase the magnetic field exerted by the permanent magnet and acting on the switch when the body is in the vicinity of the switch. This means that the one pole of the permanent magnet not connected with the contact element must be facing the body to be transported past the permanent magnet, and that, on the contact element not continuously connected with the other pole of the permanent magnet, there must be a conductor of a ferromagnetic material, which also faces the body. The amplification of the magnetic flux and, therefore, also the amplification of the magnetic field takes place at the contactless proximity switch element 11 according to the embodiment primarily in the vicinity of the contact element 9, which is not continuously connected with one pole of the permanent magnet.

It is also conceivable that two permanent magnets can be provided parallel to one another and at a specified distance from one another, between which the proximity switch apparatus can be placed, so that its contact elements are located in a region of the magnetic field produced by the two permanent magnets whose field strength is equal to or approximately zero. The switch is connected via connecting wires with corresponding blade contacts.

As a result of the magnetic field produced by the two permanent magnets oriented in opposite poles, the proximity switch apparatus is braced at its connections by means of the corresponding field strength. On the housing, there can be two lug-like projections forming a magnetically conductive connection with the permanent magnets, which come into contact with the jacket surface of the work cylinder during installation of the proximity switch apparatus. A proximity switch apparatus of the type described above operates as follows. Since, on both sides of the proximity switch apparatus, the field strength of the magnetic field produced by the two permanent magnets is produced by opposite poles whose amounts are equal, the proximity switch apparatus is not excited to switch. A switching of the contacts can only be achieved if the switch is either moved closer to one of the permanent magnets, or if the magnetic field of one of the two permanent magnets is interrupted, and the influence of the other permanent magnet increases. If the piston provided with the ferromagnetic portion moves inside the work cylinder and thereby arrives in the vicinity of one of the permanent magnets, then the lines of flux take the path of least resistance (i.e., the ferromagnetic part on the piston) and thereby deviate from their prior course. The disruption of the magnetic field produced in this manner causes the contacts on the proximity switch appartus to switch. the shifting of the lines of flux causes an amplification of the magnetic field in the vicinity of the switch contacts.

It is also possible to modify the embodiment by replacing the reed contact elements with field plates which can also be installed in the proximity switch apparatus described above.

We claim:

1. A contactless proximity switch and mounting arrangement for determining the position of a movable member within a cylinder, said contactless proximity switch and mounting arrangement comprising:

(a) a switch housing mounted at a predetermined position on the cylinder;

(b) a contact opening formed in said switch housing having a portion thereof open toward an exterior surface of the cylinder;

(c) a permanent magnet disposed in said contact opening and having a first pole in contact with the exterior surface of the cylinder;

(d) a switch element having at least a first and second contact member being disposed in said contact opening, said first contact member being coupled to a second pole of said permanent magnet, and said second contact member being electrically connected to the exterior surface of the cylinder at a spaced-apart position relative to where said first pole of said permanent magnet contacts the exterior surface; and (e) the movable member being composed of a ferromagnetic material which, as the movable member nears to within a predetermined distance of such predetermined position, allows a magnetic field exerted by said permanent magnet to be conducted thereover such that such spaced-apart position between said first pole of said permanent magnet and said electrical connection to said second contact member is bridged thereby closing said first and second contact members.

2. A contactless proximity switch and mounting arrangement, as set forth in claim 1, wherein said switch element is a reed switch and wherein said first contact member is connected to a first plug contact and said second contact member is connected to a second plug contact.

3. A contactless proximity switch and mounting arrangement, as set forth in claim 1, wherein said movable member is a piston reciprocally movable within the cylinder under the influence of fluid pressure introduced to at least one chamber formed in the cylinder.

4. A contactless proximity switch and mounting arrangement, as set forth in claim 1, wherein the cylinder is constructed having two end members secured at opposite ends of the cylinder and joined by at least one tie rod member which extends for the length of the cylinder.

5. A contactless proximity switch and mounting arrangement, as set forth in claim 1, wherein said switch housing has an arcuately-shaped inner contoured surface which contacts at least a portion of the exterior surface of the cylinder.

6. A contactless proximity switch and mounting arrangement, as set forth in claim 4, wherein said switch housing is secured to said tie rod member on the cylinder at such predetermined position.

7. A contactless proximity switch and mounting arrangement, as set forth in claim 6, further comprising a clamping means partially formed on said switch housing for securing said switch housing to one of said at least one tie rod member in a manner which allows for modification of such predetermined position along the longitudinal axis of the cylinder.

8. A contactless proximity switch and mounting arrangement, as set forth in claim 7, wherein said clamping means includes a rod opening substantially contoured to said tie rod member diameter, a slot, which allows for adjustment of said rod opening and a clamping screw which can be operated to adjust the width of said slot.

9. a contactless proximity switch and mounting arrangement, as set forth in claim 7, wherein said clamping means includes a jaw-shaped opening which surrounds a portion of said tie rod member and at least one fastening screw which, when loosened, allows said switch housing to pivot about said one of said at least one tie rod member.

10. A contactless proximity switch and mounting arrangement, as set forth in claim 4, further comprising:

(a) at least one lug-shaped projection formed on said switch housing and in contact with the exterior surface of the cylinder;

(b) at least one pivot pin formed on the switch housing in the direction of the longitudinal axis of the cylinder;

(c) a lever member secured at one end to one of said at least one tie rod member and having formed on the opposite end, at least one pivot opening in which said at least one pivot pin fits such that said switch housing can be pivoted relative to said lever member.

11. A contactless proximity switch and mounting arrangement, as set forth in claim 10, wherein said lever member has formed at said one end, a jaw-shaped opening which substantially surrounds said one of said at least one tie member, said lever member being pivotable about said one of said at least one tie rod member upon loosening of at least one fastening screw which secures said lever member to said one of said at least one tie rod member.

12. A contactless proximity switch and mounting arrangement, as set forth in claim 10, wherein said lever member narrows in dimension at said opposite end where said pivot opening is disposed, such narrowing of said opposite end approximately following the exterior surface of the cylinder.

* * * * *

UNITED STATES PATENT AND TRADEMARK OFFICE

CERTIFICATE OF CORRECTION

PATENT NO. : 4,680,436

DATED : July 14, 1987

INVENTOR(S) : Walter Brausfeld, Helmut Gottling, Rudolf Moller, Peter Muller, Gerhard Scharnowski It is certified that error appears in the above-identified patent and that said Letters Patent are hereby corrected as shown below:

Column 8, line 55, after "tie", insert --rod--

Signed and Sealed this

Twelfth Day of April, 1988

*Attest:*

DONALD J. QUIGG

*Attesting Officer*

*Commissioner of Patents and Trademarks*